US005289946A

United States Patent [19]

Fuchs

[11] Patent Number: 5,289,946

[45] Date of Patent: Mar. 1, 1994

[54] DISPENSER FOR MEDIA

[75] Inventor: Karl-Heinz Fuchs, Radolfzell, Fed. Rep. of Germany

[73] Assignee: Ing. Erich Pfeiffer GmbH & Co. KG, Radolfzell

[21] Appl. No.: 752,047

[22] Filed: Aug. 29, 1991

[30] Foreign Application Priority Data

Aug. 31, 1990 [DE] Fed. Rep. of Germany ..... 4027670

[51] Int. Cl.[5] ..... B67D 5/26

[52] U.S. Cl. ..... 222/38; 222/36

[58] Field of Search ..... 222/36, 38; 221/7; 235/94 R; 116/284, 309, 311

[56] References Cited

U.S. PATENT DOCUMENTS

| | | | |
|---|---|---|---|
| 3,344,951 | 10/1967 | Gervais | 221/7 |
| 3,511,409 | 5/1970 | Huck | 221/7 |
| 3,549,057 | 12/1970 | Perez | 222/249 |
| 3,796,348 | 3/1974 | Zipper | 222/38 |
| 3,802,608 | 4/1974 | Gullett | 222/309 |
| 4,565,302 | 1/1986 | Pfeiffer et al. | 222/38 |
| 4,705,182 | 11/1987 | Newel-Lewis . | |

FOREIGN PATENT DOCUMENTS

| | | |
|---|---|---|
| 0028929 | 5/1981 | European Pat. Off. . |
| 0114617 | 8/1984 | European Pat. Off. . |
| 0098939 | 12/1987 | European Pat. Off. . |
| 0269496 | 6/1988 | European Pat. Off. . |
| 6603758 | 7/1969 | Fed. Rep. of Germany . |
| 2702539 | 8/1977 | Fed. Rep. of Germany . |
| 8590143 | 4/1986 | Fed. Rep. of Germany . |

*Primary Examiner*—Andres Kashnikow
*Assistant Examiner*—Lesley D. Morris
*Attorney, Agent, or Firm*—Quarles & Brady

[57] ABSTRACT

A discharge apparatus (1) having a storing and indicating device (20), which is operated by the discharge actuating means (5) and is also adjustable in a single direction by direct manual actuation of a further actuator (23). Thus, indicating symbols of different scales (40) can be rendered visible in such a way that an indication or display advantageous for numerous applications is provided.

23 Claims, 2 Drawing Sheets

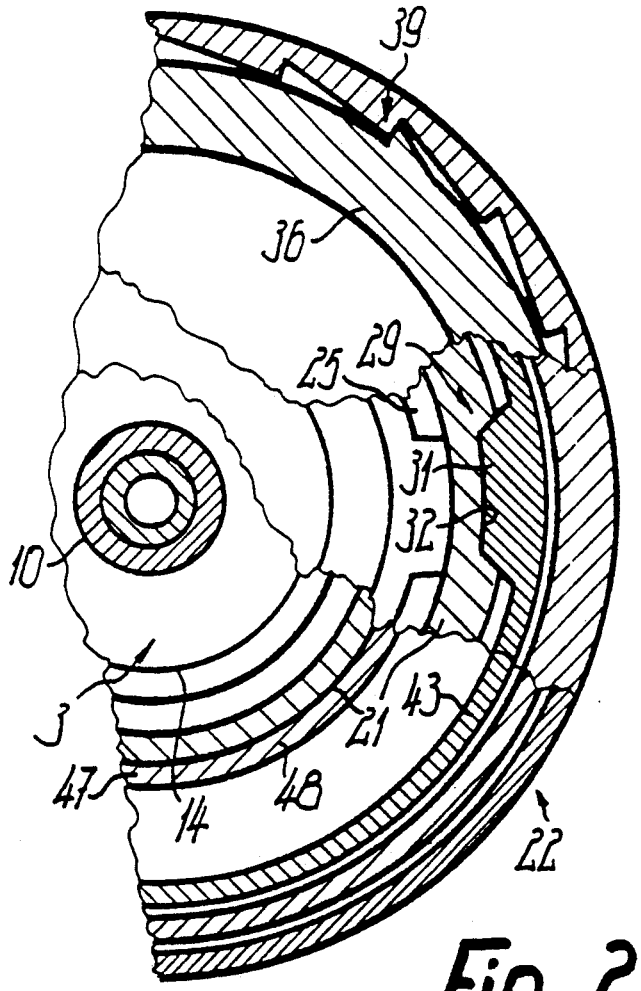
Fig. 2
Fig. 3
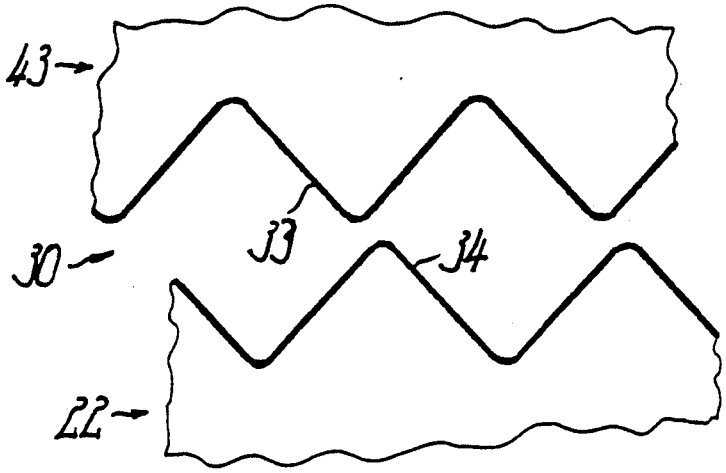

DISPENSER FOR MEDIA

BACKGROUND OF THE INVENTION

The invention relates to a discharge apparatus for media, particularly for flowable media of a random type, in which one or more preferably manually operable discharge actuating means are provided. The discharge apparatus has one or more determination devices for random data, particularly for storing and indicating/displaying such data, which are associated with the discharge processes performed or to be performed with the discharge apparatus. Such data can e.g. be provided for counting the discharge processes performed or for determining at least one following discharge process.

European patent 114 617 discloses a counting mechanism, in which each pump stroke leads to an indexing of the counting mechanism by a determination unit, because the actuator of the discharge actuating means is simultaneously the actuator for the determination device. This construction has proved satisfactory in many cases.

SUMMARY OF THE INVENTION

The problem of the invention is to provide a discharge apparatus for media, which is improved compared with known discharge apparatuses at least in special uses and which in particular permits a random action in the control means for the determination device independently of the discharge actuating means.

For solving the problem the determination device is controllable by means of two separate actuators, whereof appropriately one or both are manually operated. As a result widely differing switching or indexing processes for the determination device can be obtained. For example, by one actuator at the start of the use of the discharge apparatus it is possible to forcibly initiate an indexing process by the first discharge actuation and subsequently discharge actuations are repeatedly performed without there being a further indexing process. At the end of the use process by the direct actuation of a further actuator with respect to the same data determination a further indexing step can be performed. The latter indexing step or a further step performed with a further actuator can be provided for returning the determination device to its starting position in such a way that necessarily an indexing process takes place during the next discharge actuation. In addition, said construction is suitable, following the first discharge actuation and e.g. at the start of a use day, to bring about the appearance of a specific related indication or display, whilst by operating the further actuator, e.g. at the end of a use day, an indication or display of another type appears, e.g. in the form of a symbol or number, which indicates the use stages performed or still to be performed, the next-following use stage, etc. Thus, to this extent the determination device is also suitable as an originality protection, because the first use of the discharge apparatus is rendered clearly visible.

It is conceivable to couple each of the actuators with a separate adjusting member of the determination device or to construct one or both actuators substantially in one piece with the associated adjusting member. If an adjusting member is controlled by the discharge actuating means, then it is appropriately formed by a component separate from the associated discharge handle, which can also be constructed in the manner of a drag member, so that it is only forcibly entrained or driven in one direction by the associated handle, namely e.g. in the actuating direction, but cannot be returned again to the starting position by the handle. Thus, a corresponding display or indication can be maintained independently of the further operation of said handle and is only erased by operating a further actuator through the return of the adjusting member and a further display or indication type is made visible. Symbol or indicating scales can be distributed directly axially successively and/or circumferentially on the adjusting member. The latter appropriately forms with one end face a driver for the associated handle and forms with the other end an indexing member for the servodrive, which is engaged or disconnectably engageable with a counter-member of the further actuator or a further adjusting member connected thereto.

It is particularly appropriate if the discharge apparatus can be equipped with and without a determination device, or with different determination devices or indicators, without any significant modification to the discharging means and a medium reservoir fixed thereto. Thus, the same discharge apparatus can be designed for different use modes, e.g. solely for performing one or more plug-in processes. Advantageously following the removal of a mounted actuating and/or nozzle cap of the discharge actuating means, the complete determination device or only the scale carrier or indicator is removable, insertable or replaceable. At least one component of the determination device and in particular the body, is appropriately solely fixed by a snap connection on the outer circumference of the discharge unit comprising the discharging means and the medium reservoir. Such a construction is also suitable for discharge apparatuses, in which the determination device is only manually controllable with a single actuator or in which the reservoir is made from glass.

These and further features can be gathered from the claims, description and drawings and the individual features, either singly or in the form of sub-combinations, can be realized in an embodiment of the invention and in other fields and can represent advantageous, independently protectable constructions for which protection is hereby claimed.

DESCRIPTION OF DRAWINGS

An embodiment of the invention is described in greater detail hereinafter relative to the drawings, wherein show:

FIG. 2 The adjusting device of FIG. 1 in cross-section.

FIG. 3 A detail of FIG. 1.

DETAILED DESCRIPTION OF THE INVENTION

Figure 1:
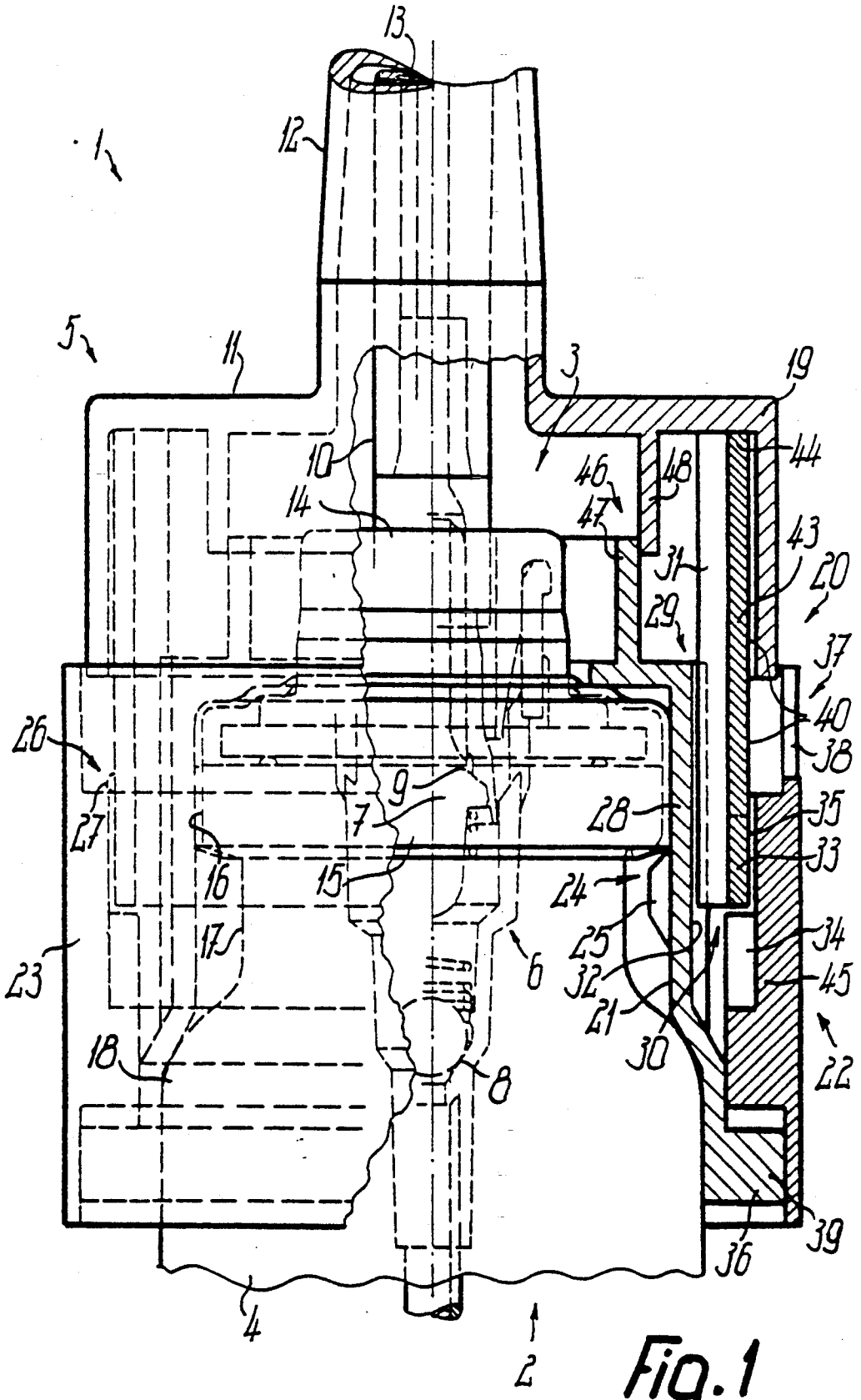
FIG. 1 An inventive discharge apparatus in part sectional view.

The dispenser 1 has a discharge unit 2 constructed as a closed assembly and which has a discharging means 3 and a storage vessel 4, which are manually operated by a discharge actuating means 5. The piston unit 7 of a pump 6 largely engaging in the storage vessel 4 is operated and its pump chamber has a valve-controlled inlet 8 and a valve-controlled outlet 9. For operation purposes a piston or actuating rod 10 is provided, which is connected to a delivery handle or an actuator 11 in the form of a pressure surface surrounding the same and is placed by means of a plug-in connection on the piston rod of the piston unit 7. The operating or actuating rod 10 is traversed by an outlet channel 13 connected to the outlet 9, is surrounded by a discharge connecting piece 12 constructed in one piece therewith and located roughly in the pump axis and has in the vicinity of its end face the discharge nozzle of the discharge unit 2 leading into the open. The cylinder casing forms with a cylinder cover a body 14 with which the discharging means 3 is fixed to the vessel neck 17, e.g. in the form of a crimp ring engaging round a cap-like vessel flange 16. Between the vessel flange 16 and the vessel bulge 18 the vessel neck 17 forms on the outer circumference a circular groove, which can be bounded on one side by the fastening member 15. The part of the body projecting from the storage vessel 4 and the fastening member 15 are engaged over by a cap 19, which with its end face forms the actuator 11.

For determining every first delivery or pumping process following a random transfer into a determination state, a determination device 20 is provided, which is fixed by engagement only and as a separate subassembly with a body 21 to the discharge unit 2. It carries on the outer circumference of the body 21 a substantially axially secured, but stepless and/or stepwise rotatable, sleeve-like determination member 22, whose outer circumference is partly or completely exposed in such a way that it can be manually gripped as a further actuator 23. The inner circumference of the sleeve-like body 21 is centred on the outer circumference of the fastening member 15 and/or the vessel bulge 18, is axially fixed by a stop member on the front face of the fastening member 15 and/or the vessel bulge 18 and is protected against removal by a snap connection 24. The latter has on the inner circumference of the resiliently expandable body 21 snap cams 25 distributed over the circumference and which engage in the circular groove of the discharge unit 2 formed in the vicinity of the vessel neck 17 and e.g. engage behind the rear face of the vessel flange 16 or the fastening member 15. Following the engagement of the determination device 20 with the operating rod 10 on a piston rod of the otherwise preassembled discharge unit 2, the cap 19 can be engaged and consequently assembled in substantially the same direction.

Within the jacket of the cap 19 is provided a sleeve-like adjusting member 43, which also engages in an inner circumference of the determination member 22 or an adjusting portion 45 constructed in one piece therewith. The adjusting member 43 is axially displaceable and rotatable both with respect to the actuator 11 and with respect to the determination or adjusting member 22, 45. With respect to the determination or adjusting member 22, 45, the adjusting member 43 can be secured in at least one position axially by an arresting means which still allows the rotation movement against one another. For this purpose on an inner circumference of the adjusting portion 45 and/or on an outer circumference of the adjusting member 43 is provided an e.g. toroidal stop cam 27, which runs with a certain friction on the circumferential surface of the in each case other adjusting member and in the case of two stop cams on both adjusting members can form a resilient snap locking means. The arresting means is appropriately provided in such a way that the adjusting member 43 in the initial position is not displaced by weight force with respect to the actuator 11 and thereby arrives in an indicating position different from the associated position. For the displacement of the adjusting member 43 the actuator 11 must be actuated and an end of the adjusting member 43 on the inside of the end wall of the cap 19 forms a driver 44. If subsequently the actuator 11 is released and e.g. returns to its starting position under the tension of a return spring of the discharging means 3, then it does not carry with it in the manner of a freewheel the adjusting member 43, because the latter is secured by the arresting means 26.

The adjusting member 43 is prevented from twisting with respect to the body 21 by a rotation preventing means 29, which has on the inner circumference of the adjusting member 43 at least one locking cam 31 formed by an approximately axial web and a locking groove 32 on the outer circumference of a jacket 28 of the body 21 displaceably receiving said cam in each operating position.

In the vicinity of the rear end portion 35 remote from the driver 44 the adjusting member 43 forms part of a servodrive 30, which is so constructed that an axial movement of the adjusting member 43 leads to a rotary movement of the determination member 22 and conversely a rotary movement of the latter leads to an axial return movement of the adjusting member 43. For this purpose the end of the adjusting member has a tooth-like construction with circumferentially uniformly distributed, axially substantially freely projecting adjusting cams 33, which are in each case bounded by two sloping cam sides. Substantially identical, oppositely projecting counter-cams 34 are provided on the inner circumference of the determination member 22, which is constructed in one piece with the adjusting portion 45 and the actuator 23.

A rear end portion of the determination, actuating or adjusting member 22, 23, 45 surrounds a rear, widened collar 36 of the body 21 and is prevented from rotating with respect thereto by a force-dependent overcomeable catch system 39 and in the manner of a freewheel is only rotatable in one rotating direction and is prevented from rotating in the other direction. For this purpose the collar 36 has sawtooth-like locking teeth distributed over its outer circumference and with which are associated on the inner circumference of the in this area elastically expandable determination member 22 a sawtooth-like countertooth system. The catch spacing of the catch system 39 e.g. corresponds to half the tooth pitch of the servodrive 30. Thus, the determination member 22 is rotated on by one catch during an axial stroke of the adjusting member 43. Through a random further rotation of the determination member 22 by a further catch the adjusting member 43 is axially forcibly returned again.

For the indication of the aforementioned data so as to be visible from the outside in at least certain operating positions, an indicator 37 is provided, which has on the front end of the determination member 22 an indicating window 38 in the form of an opening in the jacket. This front end engages over the outer circumference of the jacket of the cap 19 at least during the pump stroke and particularly also in the starting position, so that only in the starting position of the cap 19 does the indicating window 38 make it possible to see the circumference of the adjusting member 43, but conceals same at the back in the pump stroke end position. The adjusting member 43 is constructed as a scale carrier and has one or two axially succeeding scales 40 with scale symbols distributed over the circumference in accordance with the spacing or pitch of the servodrive 30 or the catch system 39. A corresponding scale could be provided on the outer circumference of the jacket of the cap 19. In the starting position of the adjusting member 43 and the actuator 11, a scale 40 is so positioned behind the indicating window 38 that a scale symbol is visible from the outside.

If the actuator 11 is pressed down for performing a discharge process and the adjusting member 43 is driven with it, said scale symbol, including the entire scale, passes behind the closed jacket of the determination member 22, whilst the further scale previously behind the jacket of the cap 19 passes into the vicinity of the indicating window 38. Simultaneously the determination member 22 is rotated on by one of the said partial steps via the servodrive 30. If by release the actuator 11 now returns to its starting position, the adjusting member 43 remains in its axial position with respect to the determination member 22 and the scale symbol of said second scale is so freed by the retraction of the cap jacket, that it can be seen through the indicating window 38. The actuator 11 can now be operated a random number of times without any change to the determination state of the determination member 22. By manual rotation of the determination member 22 by a further spacing of the catch system 39 the first-mentioned scale is again transferred into the vicinity of the indicating window 38, so that a further scale symbol can be seen from the outside. A following actuation of the discharging means 3 leads to a further indexing step of the determining member 22. All the return movements can be brought about by the single spring of the discharging means 3.

Appropriately the actuator 11 is directly guided on the body 21 by means of a guide 46 constructed as a plug-in connection, so that no bearing forces have to be transferred to the determining member 22 or the adjusting member 43. The body 21 has a cylindrical bush 47 projecting over its front, ring-like end wall supported on the associated end of the fastening member 16 and which surrounds the cylinder cover of the pump 6 on the outer circumference and with a spacing and on whose outer circumference is slidingly guided the actuator 11 with a corresponding, freely projecting bush 48, which is provided on the inside of the end wall of the cap 19. The guide 36 also bounds a cross-sectionally annular space on the inner circumference in a substantially tight manner with respect to the space traversed by the discharging means 3. This annular space contains the rotation preventing means 29, the servodrive 30 and the adjusting member 43, which in turn forms a substantially tight telescopic boundary for the outer circumference of the annular space, because in each position it engages in relatively tight manner with both ends in the inner circumferences of the cap 19 and the determination member 22.

I claim:

1. A dispenser for discharging media comprising:

at least one discharge actuating means;

at least one determination device having an unoperated initial position; and at least one actuator for controlling said at least one determination device, wherein catch means are provided for positionally locking said at least one actuator in said initial position and for releasing said at least one actuator to a further position when unlocked by a manual locking stress overcoming a locking stress of said catch means.

2. The dispenser according to claim 1, wherein at least two actuators are provided, wherein at least one of said two actuators is formed by an actuating handle for said at least one discharge actuating means and wherein at least one of said two actuators is manually operable independently of said discharge actuating means.

3. The dispenser according to claim 1, wherein control means are provided for operationally moving at least one determination member of said at least one determination device substantially directly over only a first part of a registering path defined between two memory positions with a first actuator via a servodrive and for moving said determination member on a following second part of said registering path by a second actuator.

4. The dispenser according to claim 1, wherein said at least one actuator and at least one actuating member is operationally connectable by means of an engageable and disengageable servodrive with at least one determination member of said at least one determination device and a further actuator provided for directly actuating said determination member.

5. The dispenser according to claim 1, wherein at least one adjusting member of said at least one determination device is positively connected as a drag member to said actuator only in a single operating direction, said actuator being returnable to an initial position independently of said adjusting member.

6. The dispenser according to claim 5, wherein said adjusting member has a driver located in a motion path of a driving surface of said actuator.

7. The dispenser according to claim 1, wherein at least first and second actuators are provided, said first actuator being returnable to said initial position independent from at least one adjusting member of said at least one determination device, said adjusting member being operationally engageable with said second actuator by actuating said first actuator.

8. The dispenser according to claim 1, wherein at least two actuators are provided, and wherein said at least one determination device has at least one adjusting member that is operationally movable in a first direction with a fist one of said two actuators and substantially only in an opposite second direction with a second one of said two actuators.

9. The dispenser according to claim 1, wherein at least two actuators are provided, wherein said at least one determination device has at least one adjusting member that forms an indicating member of an indicator, and wherein upon actuation of one of said two actuators said adjusting member couples said actuators from an uncoupled state.

10. The dispenser according to claim 9, wherein said at least one adjusting member has on a circumference at least one indicating scale associated with an indicating window provided on a manually rotatable adjusting member.

11. The dispenser according to claim 1, wherein at least one rotary actuating member and at least one rotary adjusting member of said at least one determination device is positionally lockable with said catch means disengageable in a force-dependent manner.

12. The dispenser according to claim 1, wherein said catch means has at least one catch serration on an inner circumference, wherein said at least one determination device has a control serration of a servodrive, and further comprising an indicator in the vicinity of an end of said determination device.

13. The dispenser according to claim 1, wherein said at least one actuator is constructed substantially in one part with at least one of an adjusting member and a determination member of said at least one determination device.

14. The dispenser according to claim 13, wherein said at least one actuator forms an outer protective jacket for at least one of a control drive, a servodrive, a rotation preventing guide and said catch means of said determination device.

15. The dispenser according to claim 1, wherein means are provided for operationally coupling said determination device substantially exclusively via a driver with said discharge actuating means, thereby providing means for commonly displacing said actuator and said driver in a common direction, said driver being separate and releasable from said actuator.

16. The dispenser according to claim 15, wherein an operationally axially movable adjusting member of said determination device is positioned within an actuating cap of said discharge actuating means and is engageable with an end wall of said cap.

17. The dispenser according to claim 1, wherein a basic body is provided and an adjusting member of said determination device has a sleeve-like form and is prevented from rotating relative to said basic body mountingly receiving in rotary manner at least one of an additional adjusting member and an actuating member for said determination device.

18. The dispenser according to claim 1, further comprising a discharging means assembleable with a storage vessel prior to and independently from said determination device, a fastening member being provided for positionally and operationally securing said discharging means to said storage vessel, and a body separate from said fastening member being provided for mounting said determination device on said storage vessel.

19. The dispenser according to claim 1, wherein in a preassembled state, said determination device has a basic body engageable on an outer circumference of a preassembled discharge unit including discharging means and a storage vessel for assembling said determination device with said preassembled discharge unit via a plug-in motion.

20. The dispenser according to claim 19, wherein said basic body has on an outer circumference at least one rotation preventing means for directly interlocking an adjusting member of said determination device, and said basic body and said adjusting member being separate from said actuator.

21. A dispenser for discharging media comprising: at least one discharge actuating means; at least one determination device; at least two separate actuators for indexing said at least one determination device over an indexing path extending between two successive determination positions, said indexing path including partial paths and at least two actuators being operable in at least one of two modes of operation, the two modes of operation comprising a predetermined sequence of operations and at least two successive operations, said determination device being operable by said two actuators that follow corresponding partial paths of said indexing path.

22. The dispenser according to claim 21, further comprising two control members for controlling operation of said determination device and wherein at least two of said two control members and said two actuators of said determination device provide diverging operating directions.

23. The dispenser according to claim 22, wherein said operating directions include an axial operating direction and a rotary operating direction.

* * * * *

UNITED STATES PATENT AND TRADEMARK OFFICE

CERTIFICATE OF CORRECTION

PATENT NO. : 5,289,946

DATED : March 1, 1994

INVENTOR(S) : Karl-Heinz Fuchs

It is certified that error appears in the above-identified patent and that said Letters Patent is hereby corrected as shown below:

Col. 5, line 65 "manual locking" should be --manual unlocking--.

Col. 6, line 42 "fist" should be --first--.

Signed and Sealed this

Second Day of August, 1994

*Attest:*

*Attesting Officer*

BRUCE LEHMAN

*Commissioner of Patents and Trademarks*